US005656235A

United States Patent [19]

Sarlitto et al.

[11] Patent Number: 5,656,235

[45] Date of Patent: Aug. 12, 1997

[54] THROUGH AIRLOCK FOR REFINING FURNANCE

[75] Inventors: Raymond Jerome Sarlitto, Yorktown Heights; Thomas Bisco, Carmel; Michael James Fisher, Mohegan Lake, all of N.Y.

[73] Assignee: Foseco International Limited, Birmingham, England

[21] Appl. No.: 379,831

[22] Filed: Jan. 27, 1995

[51] Int. Cl.[6] ..... C21C 7/10

[52] U.S. Cl. ..... 266/207; 266/236; 222/595

[58] Field of Search ..... 222/595; 75/582; 266/200, 207, 236, 237, 227, 229, 230, 231, 242

[56] References Cited

U.S. PATENT DOCUMENTS

| | | | |
|---|---|---|---|
| 1,146,573 | 7/1915 | Jacobs | 266/230 |
| 2,621,916 | 12/1952 | Murphy | 266/229 |
| 3,404,725 | 10/1968 | Kapun | 222/595 |
| 3,675,911 | 7/1972 | Kapun | 266/239 |
| 3,743,263 | 7/1973 | Szekely | 266/34 A |
| 3,870,511 | 3/1975 | Szekely | 75/68 R |
| 4,784,374 | 11/1988 | Pelton | 266/215 |
| 5,120,027 | 6/1992 | Pelton | 266/200 |
| 5,234,202 | 8/1993 | Pelton | 266/225 |

*Primary Examiner*—Scott Kastler

*Attorney, Agent, or Firm*—Nixon & Vanderhye P.C.

[57] ABSTRACT

An airlock of integral one piece construction for the trough of a refining furnace, the airlock having opposed vertical walls with portions that fit snugly within the trough opposed vertical walls and downwardly angled extensions which, with a top wall that connects the side wall extensions, define a snout whose open part projects into the molten metal in the furnace chamber to dynamically seal the trough from entry of air.

20 Claims, 2 Drawing Sheets

THROUGH AIRLOCK FOR REFINING FURNANCE

FIELD OF INVENTION

The present invention relates to apparatus for refining of molten metals, such as aluminum. More particularly, it is directed to an airlock for the through which the metal is supplied to or removed from the furnace.

DESCRIPTION OF THE PRIOR ART

Molten metals, such as aluminum, for use in producing end products of such metal, are derived from common source materials such as the primary metal or scrap. These source materials must be purified before being formed into the semi-finished product form, such as sheets or bars. Several different types of apparatus and processes are available for the purification. One of these is the commercially available SNIF® system made and sold by Praxair, the assignee of the present invention.

The SNIF system operates on a continuous basis as opposed to a batch process. During operation the source material is made to flow into an inlet trough of the SNIP® furnace in which the metal is to be purified. An inert gas, such as nitrogen or argon, is dispersed through the molton metal in the furnace through a rotating nozzle. The impurities absorb into or adhere to the gas bubbles which float to the surface of the molten metal. The gas bubbles floating to the surface release impurities to the atmosphere or they are skimmed off the surface. Chlorine can be added to the inert gas to react with the impurities and improve surface tension of the gas bubbles and thus achieve a greater degree of removal of impurities. The purified molten metal flows out of the SNIF® furnace through an outlet trough.

Apparatus and processes using the SNIF rotating nozzle system are shown, for example, in U.S. Pat. Nos. 3,743,263, 3,870,511, 4,203,581, 4,784,374, 5,120,027, 5,158,737 and 5,234,202, incorporated by reference in their entirety. In such systems, the furnace has inlet and outlet troughs through which the source metal is supplied and the refined metal removed. These troughs are usually open and admit oxygen into the furnace interior cheer. The oxygen reacts at the surface of the molten metal to oxidize and form dross, which must be removed. In addition, the standard graphite SNIP nozzle oxidizes at elevated temperatures in proportion to the concentration of oxygen in the ambient atmosphere within the furnace.

As can be seen, in order to reduce the adverse effects of oxidation, it is desirable to reduce the amount of air entering the furnace. One technique employed to reduce dross formation and nozzle oxidation includes the use of a cover gas. Here, an inert cover gas is injected into the furnace interior to blanket the molten metal surface and diffuse infiltrated oxygen. This adds expense to the refining process and increases the complexity of the refining equipment. Another approach uses refractory cloth pillows as air seals. The pillows block the trough openings from air when they are inserted into the trough(s) during furnace idle conditions. This also results in the addition of equipment and adds a step to the refining system and process. Further, these prior techniques used to solve the oxygen infiltration problem require regular operator attention.

BRIEF DESCRIPTION OF THE INVENTION

The invention relates to an airlock system for the inlet and outlet troughs of a metal refining furnace than is passive and requires minimal maintenance and attention by the operator. In accordance with the invention, an airlock is provided that has a shape corresponding to the trough opening into which it is fitted. Mating fastening elements are provided on the airlock and the furnace to securely fasten the airlock to the furnace in the trough. The part of the airlock fitting in the trough defines an internal opening for source material to flow into the furnace or an internal opening through which refined molten metal flows out.

The airlock has a snout extending from its internal opening into the furnace chamber and the snout has an open portion that projects into and is covered by the molten metal within the furnace. This arrangement provides a dynamic seal for the troughs with no moving parts. It effectively blocks, or at least substantially restricts, air from entering the furnace chamber through the trough and coming into contact with the surface of the molten metal to produce the unwanted dross, or to oxidize the graphite SNIF nozzles. The airlock also allows molten metal to flow into the furnace and out of the furnace with little or no blockage.

OBJECTS OF THE INVENTION

It is therefore an object of the invention to provide a passive airlock that forms a dynamic air seal for a refining furnace trough.

Another object is to provide a seal for a refining furnace trough that can be easily mounted securely to and easily removed from the furnace.

A further object is to provide an airlock that can be easily retrofitted into an existing refining furnace and removed without draining or cooling the furnace.

An additional object is to provide an airlock for a refining furnace that substantially blocks inlet or outlet flow of dross and infiltration of air without reducing the volume of the refining chamber.

Still a further object is to provide an airlock that blocks large foreign objects from flowing into the furnace.

Another object is, to contain a required atmosphere within a refining furnace by the use of a novel airlock.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
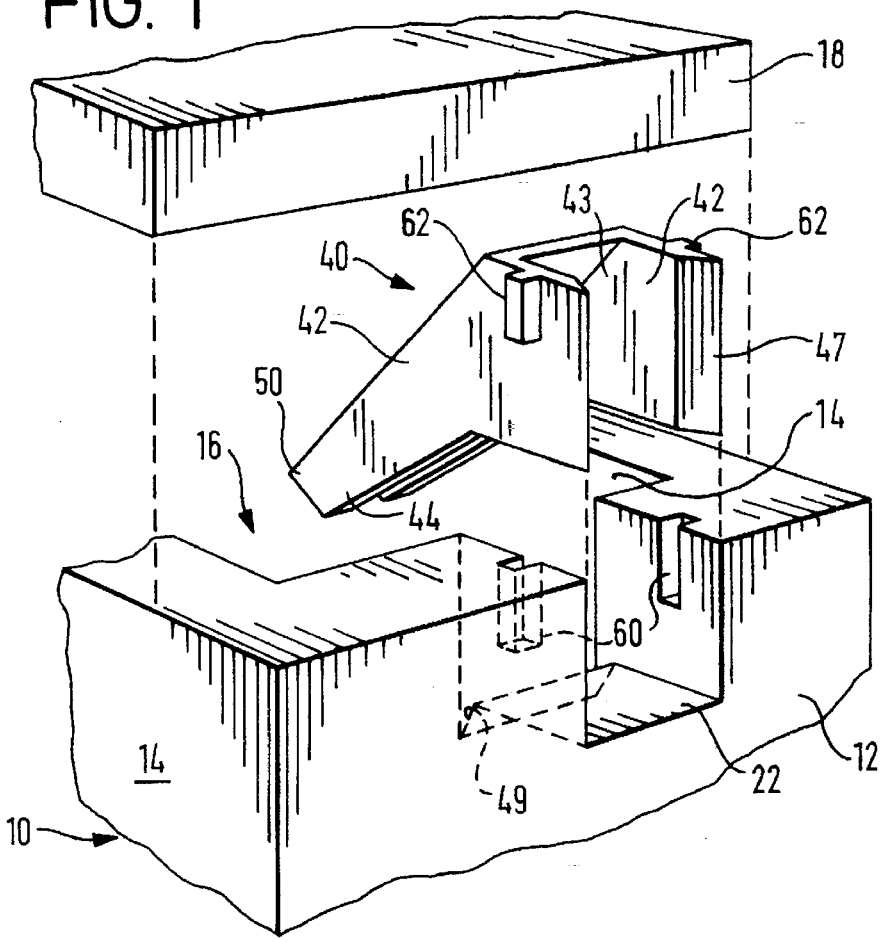
FIG. 1 is an exploded perspective view of a portion of a refining furnace and of the airlock of the invention.
Figure 2:
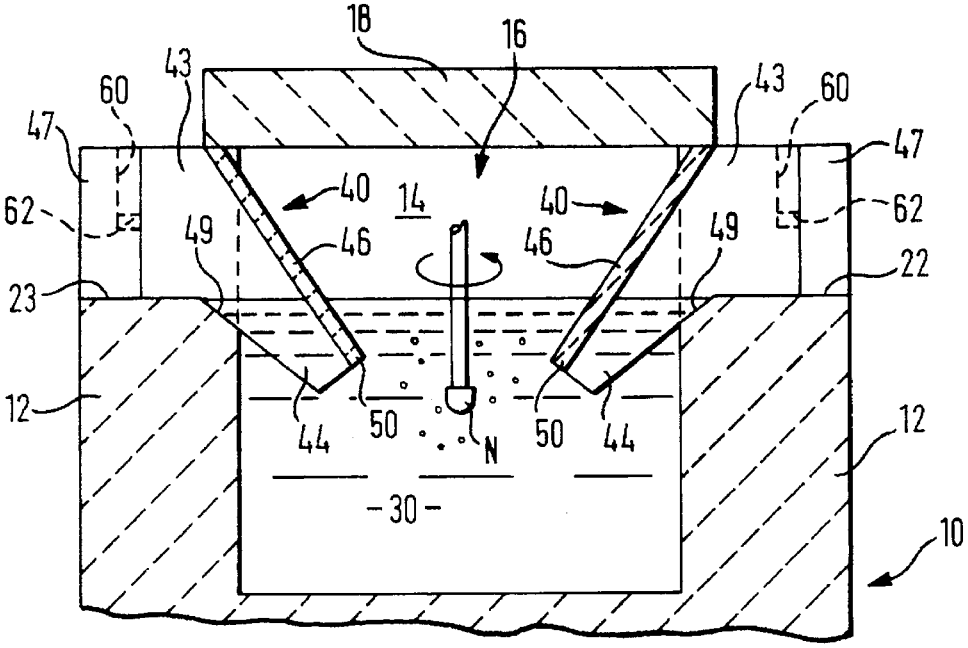
FIG. 2 is a plan view in cross section of a portion of a furnace and the airlock installed in the furnace.

FIGS. 1 and 2 show the general components of a typical refining furnace 10 for metals, such as aluminum. It includes a housing with vertical opposing front and rear walls 12 and opposing side walls 14. The walls 12, 14 are formed of or include insulating material to define a refining chamber 16. A roof 18, also of insulating material, rests on the upper edges of the walls 12, 14 to close the chamber 16. The roof can be raised by pneumatic or mechanical lifts (not shown) on the corners of the furnace to provide access to the furnace interior. The dimensions of the walls 12, 14 and the cover 18 are selected desired to produce a chamber 16 of the required capacity.

A furnace vertical wall, here shown as the front wall 12, has an inlet trough 22 through which the source metal (aluminum) is supplied to the furnace chamber 16. While the shape of the trough is shown as relatively square, it can be of any desired shape, such as rectangular with the long dimension of the rectangle being vertical. Furnace 10 has an outlet trough 23, here illustratively shown in the vertical wall 12 opposing the inlet trough 22 through which the refined molten metal (aluminum) is removed. In some types of furnaces, including the two stage type shown in U.S. Pat. No. 4,784,374, the inlet and outlet troughs can be on the same wall.

A spinning nozzle assembly, generally shown as N and described in detail in the aforementioned patents, is positioned in the molten metal below its surface. The spinning nozzle N disperses an inert gas, and another gas such as chlorine if desired, throughout the molten metal 30 to effect the refining operation.

In a typical operating configuration, the source metal (e.g. aluminum) flows into refining chamber 16 through inlet trough 22 and is kept in a molten state by heating with heat from a suitable source (not shown). The refining process is carried out by the action of the gas ejected from the spinning nozzle. The refined molten metal flows from refining chamber 16 through the outlet trough 23. The refining process is continuous. That is, the source material flows into the furnace through inlet trough 22 and the refined metal flaws out of outlet trough 23. All of the foregoing is conventional in the art.

As can be seen, if the inlet trough 22 and outlet trough 23 are left fully open, air including oxygen would enter refining chamber 16 and be present on the surface of the molten metal body 30. This would produce undesired dross that would have to be skimmed off the molten metal surface.

According to the present invention, an airlock 40 of the same construction is provided for each of the inlet and outlet troughs 22, 23. Airlock 40 is preferably an integral one piece body. It has opposing vertical side walls 42 with each wall having a rear part 43 of a height corresponding to the height of the opposing vertical side wall of a trough 22 or 23. The width of the wall rear parts 43 can be the entire or a part of the thickness of the wall Each of the airlock side walls 42 also has a downwardly projecting angled extension part 44 with a tip end 50. The side walls 42 are connected by a top wall 46 that starts at the front upper edge of the side will rear parts 43 and follows the upper edge of the angled extension parts 44. The width of the top wall 46 spaces the vertical wall rear parts 43 by a distance such that they fit snugly with the trough opposing side walls.

To securely mount the airlock 40 to the furnace, mating mounting elements are provided. In the preferred embodiment the mounting elements are integral parts of each of the airlock and furnace. As shown, these are rectangular vertical slots 60 in the upper part of the trough vertical side walls and corresponding ribs 62 on the outer surfaces of the airlock side walls 42. To mount the airlock 40 to the furnace, the roof 18 is raised and the airlock lowered into the trough with its ribs 62 being slid into the slots 60. The roof 18 is then placed back onto the top edges of the furnace vertical walls. This can be accomplished without shutting down or draining the furnace if the level of the molten metal is below that of the troughs.

While only one pair of each of the rectangular ribs and slots 60, 62 is shown for the two side walls 42, additional ones can be used if desired. According to a preferred embodiment of the invention, the mounting elements are integral with the airlock and furnace and no additional components, such as separate fasteners, are needed. Other types of fastening elements, such as, for example, bolts or rode separate from the airlock and furnace can alternatively be used.

A section 47 of the inner face of the vertical wall rear part 43 adjacent the outer face of furnace vertical wall 12 is chamfered. This provides smoother flow of the metal being added to or removed from the furnace. In the embodiment of FIGS. 1 and 2, there are no parts of the airlock opposing the trough bottom wall and no top wall spanning the tops of the side wall rear parts 43. This provides a larger internal opening area from the airlock 40 into the furnace. Supply of source material into furnace chamber 16 or removal of refined material is not unduly limited. That is, the usable area of the trough is only-reduced by the thickness of the airlock opposing side walls 42.

The airlock angled side wall extensions 44 rest on a chamfered ledge 49 on the inner face of furnace front wall 12 at the lower edge of the trough. The airlock side wall extensions 44 and top wall 46 overhang the lower, inner edge of the trough bottom wall and form a downwardly angled snout. Also, the inner volume enclosed by the side wall extensions 44 and top wall 46 forming the snout is open. Access for metal into and from the chamber 16 is unobstructed since the snout has no bottom wall opposite top wall 46.

As seen in FIG. 2, with the airlock 40 mounted in a trough 22 or 23, the lower part of the snout extends into the molten metal 30. The molten metal is at a level at or above the lower edge of the furnace wall chamfered ledge 49. Thus, the open bottom of the snout is submerged in the molten metal and there is no air path through the trough from outside the furnace. A dynamic seal is formed by virtue of the molten metal cooperating with the airlock to seal off the furnace chamber to the atmosphere. The airlock 40 is a passive component since it has no moving parts. Also, the snout extending into the molten metal does not appreciably reduce the working volume of the furnace chamber.

The airlock of the present invention can seal a furnace trough, either inlet or outlet, from inflow of air or outflow of dross during both operating and idle conditions without operator attention. It is made of a high strength refractory material that is resistant to molten aluminum and is tolerant to scraping to remove adhered dross. The airlock material is also resistant to cyclical temperature. One such material is Permatech Beta 3 made by Permatech, Inc. of Graham, N.C. This material, suited for a chamber for refining aluminum, can be cast or machined. It has sufficient strength and a resistant to attack by aluminum alloys, gases and fluxes.

Figure 3:
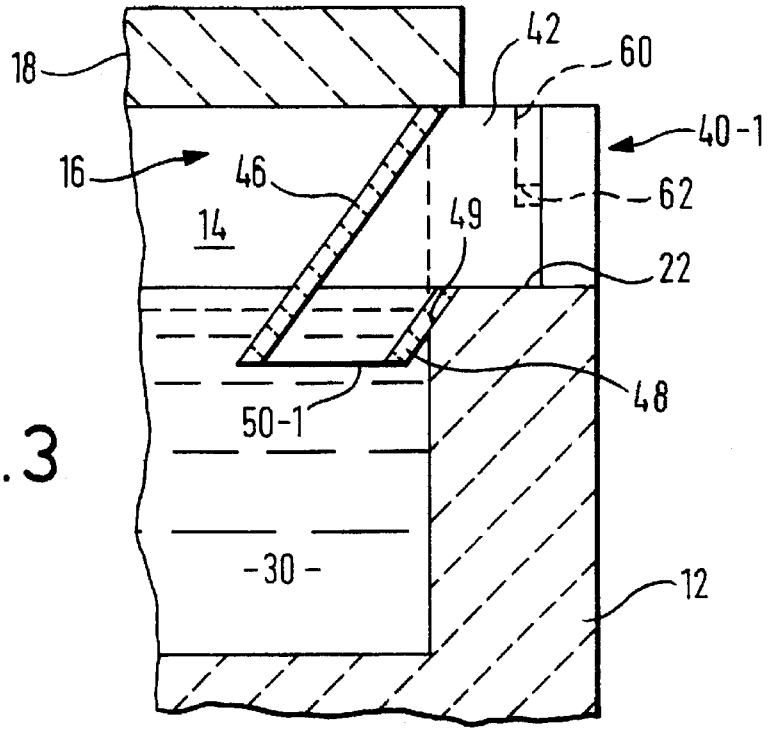
FIG. 3 is a cross-sectional view of a further embodiment of the invention.

FIG. 3 shows another embodiment of the airlock 40-1 that has a bottom wall 48 opposing the snout top wall 46. The two walls 46, 48 are shown parallel to each other and have an open tip end 50-1. If desired, the walls 47 can be made diverging to each other. The flow of metal into and out of the chamber through the snout should be restricted as little as possible. In this embodiment access to the furnace interior is through the open tip end 50-1 of the snout.

Figure 4:
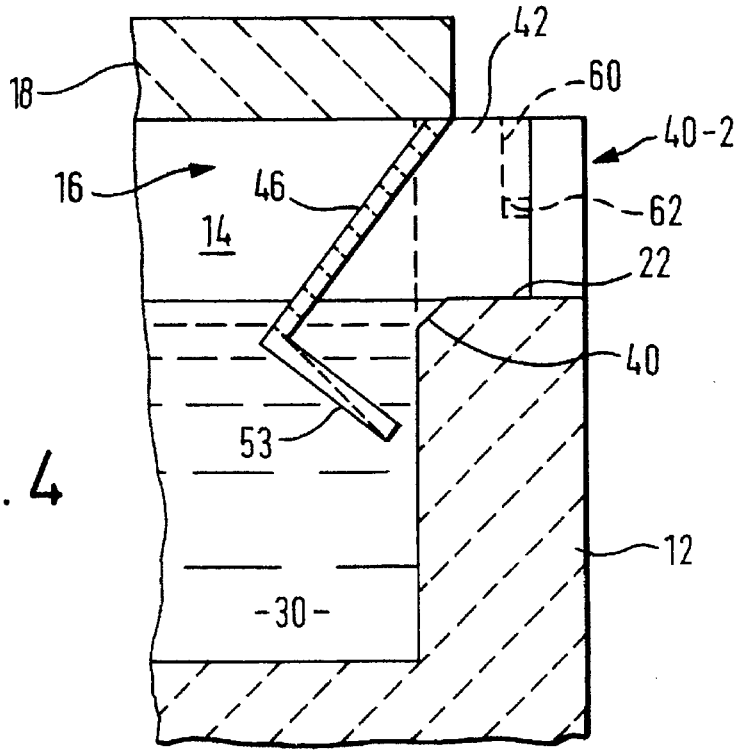
FIG. 4 is a cross-sectional view of yet another embodiment of the invention.

The embodiment of FIG. 4 is similar to that of FIGS. 1 and 2. Here, the airlock 40-2 snout also has no bottom wall opposing top wall 46. The top wall 46 has a downward extension or baffle 53 that closes off the open tip of the snout and dips into the molten metal. The extension 53 aids in retaining the gas bubbles in the refining chamber. Since there are no side walls to the portion of the snout submerged in the molten metal, there is relatively open access for inlet or outlet flow of molten metal through the snout and the respective trough 22, 23.

In each of the embodiments shown, there is a snug fit of the airlock within the respective furnace trough. The interlocking relationship of the mounting elements 60, 62 on the airlock and the furnace wall positively contains the airlock from wobble or movement. Also, the airlock can be retrofitted into an existing furnace.

The airlock does not unnecessarily limit the access area to the furnace interior chamber and does not significantly reduce internal chamber volume. Also, the airlock does not significantly restrict the flow of metal out of the furnace. Chamfer head loss at rated metal flow is typically under ½ inch. Any dross formed can be removed by skimming the mass of molten metal.

The airlock of the invention reduces infiltration of air and floating dross into or out of in-line molten metal furnaces such as used in the SNIF process. Such air infiltration is undesirable because it increases oxidation of the metal in the furnace. Oxidation of any susceptible furnace materials, such as graphite nozzles or walls, is also reduced. Blocking of floating dross is beneficial because entrained dross can be a source of inclusions in the metal.

We claim:

1. The combination comprising:

a furnace for refining molten metal having a chamber for containing molten metal, a trough in a wall of the furnace for supply of source metal into or removal of refined metal from said chamber; and an airlock fitting said trough, said airlock having walls defining an internal opening providing access from outside of said furnace into said chamber and a snout extending from said airlock internal opening projecting downwardly and inwardly of said furnace wall, said snout having an open part to be submerged in the molten metal in said chamber to form a dynamic air seal to said airlock internal opening and wherein no structural parts of said airlock significantly restrict flow of metal into or out of the furnace, and wherein pressure drop in the metal flow across said airlock is less than about 0.5 inches molten metal.

2. The combination of claim 1 wherein said snout extends at an angle downwardly from said trough.

3. The combination of claim 1 further comprising means for mounting said airlock to said furnace.

4. The combination of claim 3 wherein said mounting means comprises mating means on the part of said furnace wall surrounding said trough and on said airlock walls for interlocking said airlock to said furnace first wall.

5. The combination of claim 4 wherein said mating means comprises at least one rib on one of said airlock walls and said furnace wall and a mating slot for receiving said at least one rib on the other of said airlock walls and furnace wall.

6. The combination of claim 1 wherein said trough and said airlock fitting therein are each of generally rectangular shape.

7. The combination of claim 1 wherein said airlock walls comprise a pair of spaced walls that define therebetween said airlock internal opening and each having a rear vertical part of a size and shape corresponding to that of the adjacent vertical part of said furnace wall forming the trough and a front extension part angled inwardly of the furnace first wall and downwardly, and a top wall connecting said front extension parts and forming said snout.

8. The combination of claim 7 wherein the portion of the snout opposing said top wall is open.

9. The combination of claim 8 further comprising a downward extension on the front end of said top wall at the end of the snout.

10. The combination of claim 7 further comprising a bottom wall connecting said extension parts spaced from and opposing said top wall and leaving an opening at the end of the snout.

11. The combination of claim 1 wherein said furnace has a separate inlet trough and an outlet trough, and a said airlock in each said trough.

12. The combination comprising:

a furnace for refining molten metal having a chamber for containing molten metal, a trough in a wall of the furnace for supply of source metal into or removal of refined metal from said chamber;

an airlock fitting in said trough, said airlock having walls defining an internal opening providing access from outside of said furnace into said chamber and a snout extending from said airlock internal opening projecting downwardly and inwardly of said furnace wall, said snout having an open part to be submerged in the molten metal in said chamber to form a dynamic air seal to said airlock internal opening and wherein no structural parts of said airlock significantly restrict flow of metal into or out of the furnace; and wherein said furnace has a separate inlet trough and an outlet trough, and a said airlock in each said trough.

13. The combination of claim 12 wherein said furnace has a second wall with a trough therein, and a said airlock also fitting in said furnace second wall trough.

14. The combination of claim 12 wherein said inlet and outlet troughs are on the same wall of the furnace.

15. The combination of claim 1 further comprising a spinning nozzle extending into the molten metal to disperse gas thereto.

16. An airlock for fitting into the trough of a furnace wall comprising: a pair of spaced walls that define an airlock internal opening, each said wall of said pair having a rear part of a size and shape conforming to that of at least a part of the adjacent vertical portion of said furnace wall forming the rough and to fit therein, each of said walls having a front extension part angled downwardly therefrom and a top wall connecting said front extension part forming a snout with said front extension parts of said pair of spaced walls, said snout having an open part to be submerged in the molten metal to form a dynamic air seal to said internal opening and through which molten metal can enter or leave the furnace and wherein no structural parts of said airlock significantly restrict flow of metal into or out of the furnace, and wherein pressure drop in the metal flow across said airlock is less than about 0.5 inches molten metal.

17. The airlock of claim 16 wherein the portion of the snout opposing said top wall is open.

18. The airlock of claim 17 further comprising a downward extension on the front end of said top wall at the end of the snout.

19. The airlock of claim 16 further comprising a bottom wall connecting said extension part spaced from and opposing said top wall and leaving an opening at the end of the snout.

20. The airlock of claim 16 further comprising at least one fastening means on one of said pair of airlock walls to mate with a corresponding fastening means on the furnace wall to secure the airlock to the furnace wall.

* * * * *

UNITED STATES PATENT AND TRADEMARK OFFICE

CERTIFICATE OF CORRECTION

PATENT NO. : 5,656,235
DATED : August 12, 1997
INVENTOR(S) : Sarlitto et al

It is certified that error appears in the above-identified patent and that said letters patent is hereby corrected as shown below:

Title page, item [54] and col. 1, lines 1 and 2,

In the title, please replace "THROUGH" with -- TROUGH -- and replace "FURNANCE" with -- FURNACE --.

Column 1, line 42, replace "cheer" with -- chamber --.

Column 1, line 67, replace "than" with -- that --.

Column 3, line 2, insert -- as -- after "selected".

Column 3, line 50, replace "will" with -- wall --.

Column 4, line 20, delete the "-" [hyphen] after "only".

Column 6, line 43, replace "rough" with -- trough --.

Signed and Sealed this

Twenty-third Day of December, 1997

Bruce Lehman

*Attest:*

BRUCE LEHMAN

*Attesting Officer*

*Commissioner of Patents and Trademarks*